US009010968B2

(12) United States Patent
Gattari

(10) Patent No.: US 9,010,968 B2
(45) Date of Patent: Apr. 21, 2015

(54) UNIFORM LIGHTING REFLECTOR FOR LIGHTING APPARATUSES

(71) Applicant: Iguzzin Illuminazione S.p.A, Recanati (IT)

(72) Inventor: Massimo Gattari, Potenza Picena (IT)

(73) Assignee: Iguzzini Illuminazione S.p.A., Recanati (IT)

( * ) Notice: Subject to any disclaimer, the term of this patent is extended or adjusted under 35 U.S.C. 154(b) by 72 days.

(21) Appl. No.: 13/759,206

(22) Filed: Feb. 5, 2013

(65) Prior Publication Data

US 2013/0208485 A1 Aug. 15, 2013

(30) Foreign Application Priority Data

Feb. 10, 2012 (IT) ..... F12012A0022

(51) Int. Cl.

| | |
|---|---|
| ***F21V 7/00*** | (2006.01) |
| ***F21V 7/04*** | (2006.01) |
| ***F21V 7/09*** | (2006.01) |

(52) U.S. Cl.

CPC . *F21V 7/04* (2013.01); *F21V 7/048* (2013.01); *F21V 7/09* (2013.01)

(58) Field of Classification Search

USPC ..... 362/297, 347–348

See application file for complete search history.

(56) References Cited

U.S. PATENT DOCUMENTS

| | | | | |
|---|---|---|---|---|
| 4,021,659 | A | 5/1977 | Wiley | |
| 6,361,175 | B1 | 3/2002 | Kittelmann et al. | |
| 7,188,975 | B2 | 3/2007 | Görres | |
| 2006/0044808 | A1 * | 3/2006 | Gorres | 362/341 |

FOREIGN PATENT DOCUMENTS

| | | | |
|---|---|---|---|
| DE | 19627940 | A1 | 10/1997 |
| DE | 69130738 | T2 | 9/1999 |
| EP | 1632713 | A1 | 3/2006 |
| EP | 2375138 | A1 | 10/2011 |
| EP | 2416063 | A1 | 8/2012 |
| WO | 9217733 | A1 | 10/1992 |

OTHER PUBLICATIONS

Search Report, IT FI20120022, Aug. 6, 2012 (2 pages).

* cited by examiner

*Primary Examiner* — Sean Gramling

(74) *Attorney, Agent, or Firm* — Abelman, Frayne & Schwab

(57) ABSTRACT

The present invention relates to a reflector for light emission sources, having a rotational symmetry about an axis, an apex comprising a first opening of size such to accommodate a light source and a second opening, larger in size than the first opening, adapted to let out the direct light emitted by said light source and the light reflected by the internal surface of the reflector, surface which is characterized by a series of segments comprising a plurality of approximately rectangular surface segments in turn comprising a plurality of reliefs, preferably having a substantially hemispherical shape, and characterized by a convexity facing towards the inside of the reflector, said convexity being characterized by a single curvature radius.

11 Claims, 2 Drawing Sheets

UNIFORM LIGHTING REFLECTOR FOR LIGHTING APPARATUSES

CROSS-REFERENCE TO RELATED APPLICATIONS

This application is related to and claims priority under 35 USC§119(a) to Italian Patent Application FI2012A000022 filed on Feb. 10, 2012 which is incorporated by reference herein.

BACKGROUND OF THE INVENTION

1. Field of the Invention

The present invention relates to the technical field of lighting apparatuses, and in particular to the technical field of reflectors for lighting apparatuses.

2. Description of the Related Art

The light emission quality is one of the most important parameters of lighting apparatuses. Reflectors, diffusers and light emission devices are designed and selected so as to obtain precise lighting conditions, in terms of emission diagram and light intensity emitted, as well as in terms of lighting uniformity. The light emission uniformity may be referred to both the illuminance and the chromaticity.

When reference is made to the lighting uniformity in terms of illuminance, it is necessary to determine the differences in the density distribution of the radiated lumens. The less uniform the emission, the more perceivable the irregularities in the light distribution such as spots, or rings or light smears, which interrupt the uniformity of the emitted light field.

On the other hand, when reference is made to the lighting uniformity in terms of chromaticity, it is necessary to determine any variations in the color temperature within the lighted field due to irregularities in the light emission device. Any flaws in the emission uniformity in terms of illuminance may be due, for example, to irregularities in the reflecting surface of the reflector.

Considering the case of roto-symmetric reflectors having, for example, a parabolic or elliptic profile, we have that the reflection of a part of the emission of the light source takes place according to the local inclination of the reflector portion impinged by the incident light rays, in observance of the Euclidean theories according to which the incidence angle is equal to the reflection angle.

Roto-symmetric reflectors are generally manufactured with molding and turning techniques which often produce small irregularities on the reflecting surface, which may cause considerable non-uniformity in the beam of the reflected light emission and thus, in the illuminance produced by the lighting apparatus.

Illuminance non-uniformities may also be caused by asymmetries in the light emission sources which may, for example, be related to the non-symmetric structure of filament and halogen lamps.

Also flaws in the emission uniformity in terms of chromaticity may be due to irregularities or flaws present in the light sources used. If we consider the light sources of the metal iodide or discharge type, for example, we have that the rare earths contained in the light source bulb tend to deposit on the bottom of the same bulb over time. Therefore, if the lighting apparatus is installed so that the bulb is in vertical position and the light bulb socket at the top, the deposition of the rare earths on the bottom of the bulb has no great effect on the overall light emission whereas if the lighting apparatus is installed so that the bulb is not in vertical position, the deposition of rare earths may affect the direct emission towards the reflector, emission that will have a different chromaticity with respect to that not crossing the above deposition of rare earths. The resulting overall effect will be an emission with zones having different color temperatures, with negative consequences on the quality of the lighting provided, especially in the case of lighting of products on display or works of art displayed in museums.

In order to obviate the above-described drawbacks and make the lighting resulting from the reflection more uniform, the reflecting surface of the reflector is divided into a certain number of surface segments having each a curved or arched reflecting surface adapted to distribute the reflected light rays, making them more uniform in the space and carrying out a mixing of the reflected beam which is such as to absorb any non-uniformity in terms of illuminance or chromaticity.

f surface segments provided with curved reflecting surface are used, we have a plurality of diverging reflections so that the single reflected rays occupy the space more uniformly, thanks to a lower light density present on the surface of the single reflecting surface segments.

Intervening on the curvature radius of the surface of these surface segments it is therefore possible to directly act on the uniformity of the light emission of the lighting apparatus.

Several examples of reflectors exist in the prior art, comprising a segmented reflecting surface.

U.S. Pat. No. 6,361,175 relates to a reflector of which the reflecting surface is divided into a plurality of convex surface segments provided with a certain curvature and with a certain position with respect to the optical axis of the reflector so as to generate a resulting lighting profile having a certain shape.

U.S. Pat. No. 4,021,659 relates to a dichroic halogen lamp provided with a reflector, also provided with a reflecting surface divided into a plurality of convex surface segments provided with a curvature adapted to reach a certain mixing level of the reflected light.

Also patent DE69130738 relates to a reflector having the internal reflecting surface divided into multiple convex surface segments provided with curvature radius and arrangement with respect to the optical axis of the reflector.

Finally, patent DE19627940 relates to a reflector in which the surface segments in which the reflecting surface thereof is divided are concave.

In each of the devices object of the above patents, the reflecting surface of the reflector is divided into surface segments provided with one or more curvature radiuses through which the degree and quality of the mixing of the light beam resulting from the reflection are adjusted.

The object of the present invention is to provide a reflector that improves the prior art reflectors providing a mixing degree of the reflected light beam which is higher and more independent of possible surface flaws or of possible flaws and asymmetries of the light emission devices used.

SUMMARY OF THE INVENTION

The present invention relates to a reflector for light emission sources, having a rotational symmetry about an axis, an apex comprising a first opening of size such to accommodate a light source and a second opening, larger in size than the first opening, adapted to let out the direct light emitted by said light source and the light reflected by the internal surface of the reflector, surface which is characterized by a plurality of approximately trapezoidal surface segments in turn comprising a plurality of reliefs, preferably having a substantially hemispherical shape, and characterized by a convexity facing towards the inside of the reflector, said convexity being characterized by a single curvature radius.

DETAILED DESCRIPTION OF THE INVENTION

Figure 1:
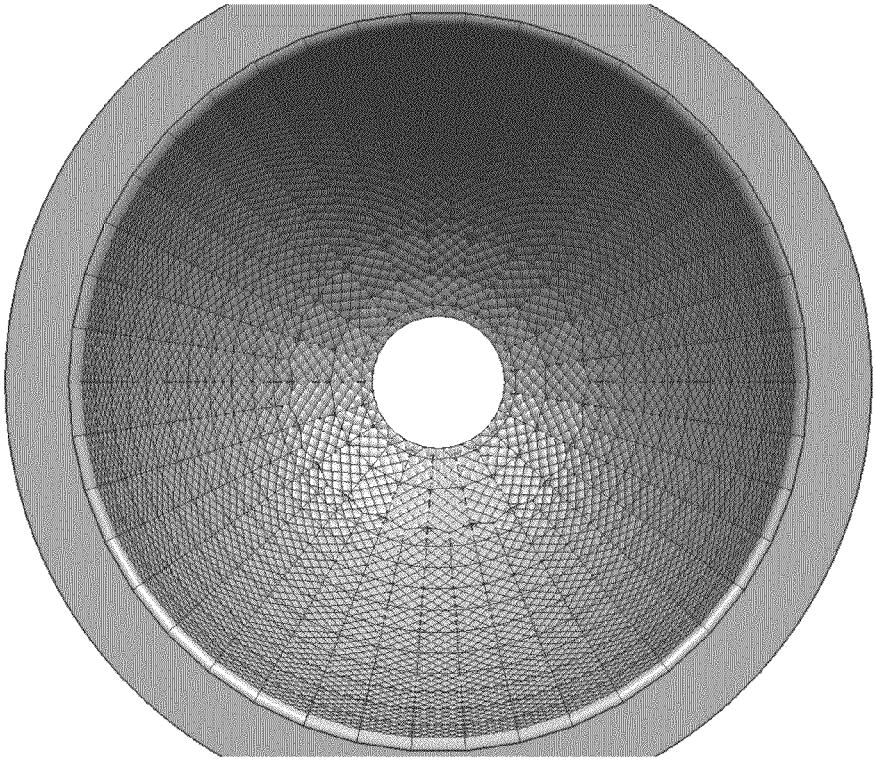
FIG. 1 shows a first view of the internal surface of the reflector according to the present invention.
Figure 2:
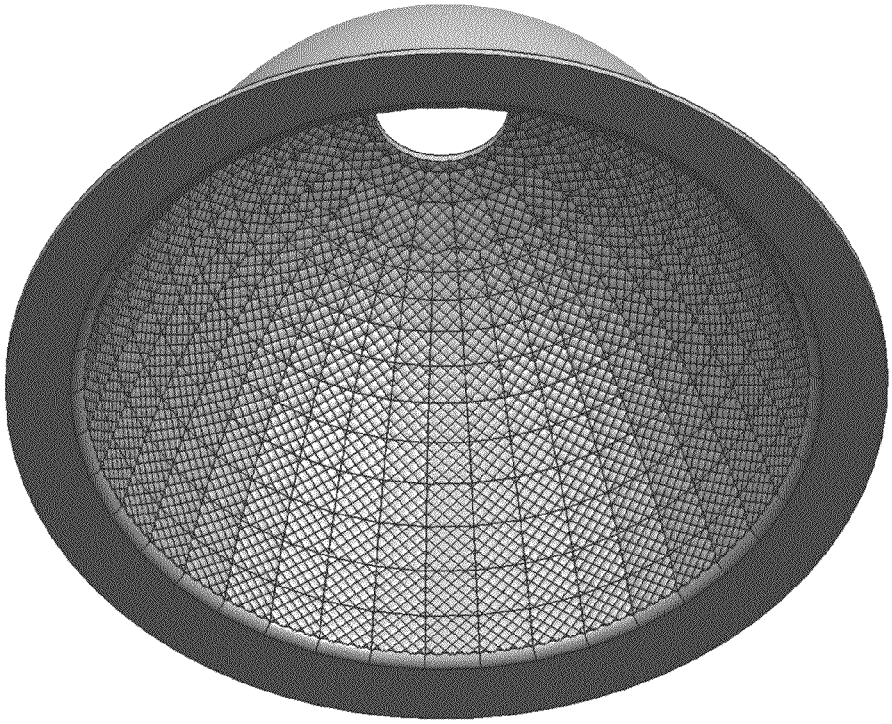
FIG. 2 shows a second perspective view of the internal surface of the reflector according to the present invention.
Figure 3:
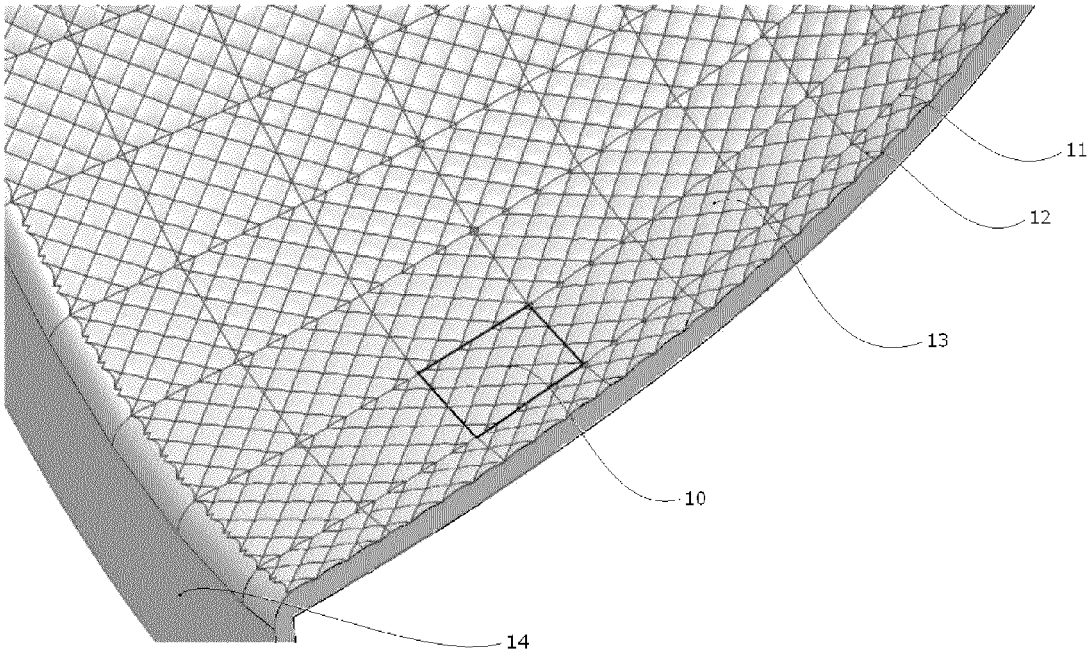
FIG. 3 shows a first detailed view of the internal surface of the reflector according to the present invention with a highlighted surface segment.
Figure 4:
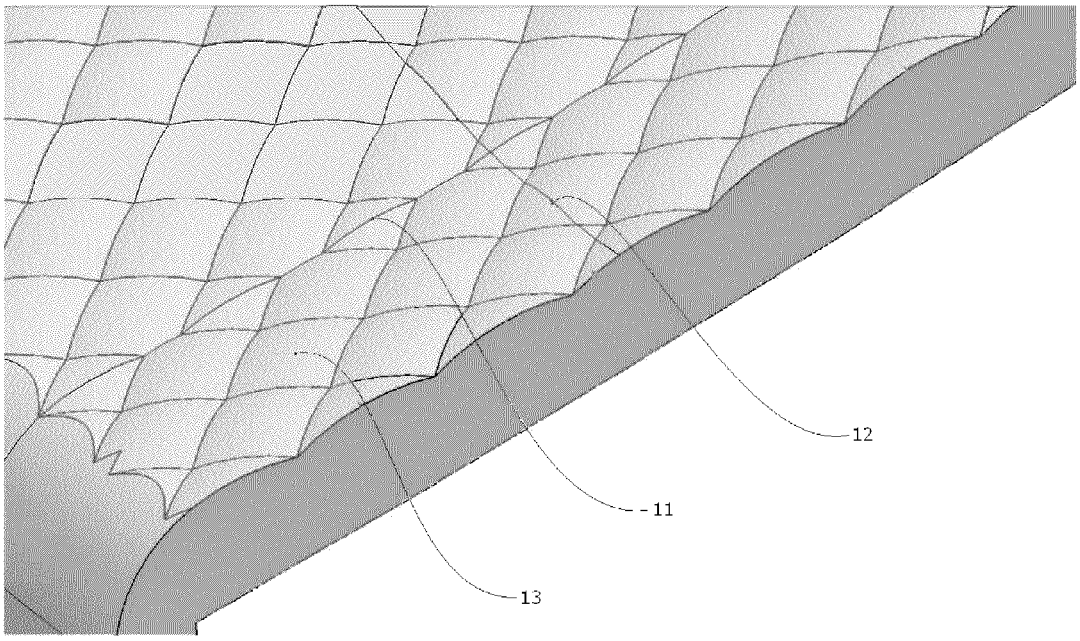
FIG. 4 shows a second detailed view of the internal surface of the reflector according to the present invention.

With reference to the annexed figures, the reflector for light emission sources according to the present invention is of the roto-symmetric type—i.e. characterized by a rotational symmetry about a rotation axis—and provided with an apex comprising a first opening of size such to accommodate a light source and a second opening, larger in size than the first opening, adapted to let out the direct light emitted by said light source and the light reflected by the internal surface of said reflector. Said two openings preferably lie on planes substantially parallel and orthogonal to the above rotation axis and have the geometric centre on said rotation axis.

The internal surface of the reflector according to the present invention is divided into a series of surface segments 10 having different size, delimited by line segments resulting from the intersection of a plurality of longitudinal, substantially curved lines 11, lying on said internal surface and originating from the geometric apex of the reflector, with a plurality of circumferences 12 lying on said internal surface as well and having the centre on said rotation axis.

Said surface segments 10, therefore, have the four vertices resulting from the intersection of said plurality of longitudinal, substantially curved lines 11—substantially equally spaced and ideally originating in the geometric apex of the reflector—with said plurality of circumferences 12 perpendicular to the symmetry axis of the reflector and parallel to each other. Said circumferences are such as to affect the whole surface of the reflector comprised between the two openings and may be, for example, equally spaced or such that the distance between two consecutive circumferences is increasing as said second opening is approached, or still, such that the distance between two consecutive circumferences is increasing up to a certain intermediate point of the surface of the reflector and then starts again from a smaller value with respect to the previous value and continues to increase up to said second opening.

In this way, the surface segments 10 are almost trapezoidal in shape and may be plane or provided with a certain convexity facing towards the inside of the reflector.

If said surface segments 10 are plane, the different angles thereof contribute to increasing the mixing degree of the reflected light, if said surface segments 10 are convex, said convexity will have a curvature depending on the curvature of the internal profile of the reflector and will be such as to provide a different light mixing effect, due to the fact that the reflected light will comprise a plurality of diverging reflections, so the single reflected rays will occupy the space more uniformly, due to a lower light density present on the surface of the single reflecting surface segments 10.

The above mixing effect is increased and optimized, in the reflector object of the present invention, by suitably covering the surface of said surface segments 10 by means of a plurality of reliefs 13 having the shape of spherical surface portions also having convexity facing towards the inside of the reflector.

In more detail and with reference to the annexed figures, in a preferred embodiment of the present invention, the reflector object of the present invention comprises an internal surface wholly divided into a plurality of surface segments 10 almost trapezoidal in shape and having the four vertices resulting from the intersection of a plurality of longitudinal lines 11—substantially equally spaced and ideally originating in the apex of the reflector—with a plurality of circumferences 12 perpendicular to the symmetry axis of the reflector and parallel to each other.

In general, said surface segments 10 will have increasing size as their position approaches said second opening and the surface segments belonging to the same circular crown, in which the internal surface of the reflector is divided by said plurality of circumferences 12, will have the same size.

Each of said surface segments 10 in turn comprises a plurality of reliefs 13 preferably having the shape of spherical surface portions also having convexity facing the inside of the reflector. Said spherical surface portions are delimited, on the surface of said surface segments 10, by a perimeter almost square in shape. In a preferred embodiment of the present invention, said spherical surface portions all have the same size and curvature radius.

In a further preferred embodiment of the present invention, said reliefs 13 completely cover the surface of said surface segments 10 and the perimeters of said reliefs 13 divide said surface segments 10 as the boxes on a chessboard. Preferably, the perimeters of said reliefs 13 are oriented so that a diagonal has an inclination with respect to said circumferences 12 within an angle comprised between +30° and −30°, and in particular is parallel to said circumferences 12. The mixing degree of the light reflected by the reflector according to the present invention is a function of the number and size of said reliefs 13 into each of the almost trapezoidal surface segment 10 in which it is divided. Therefore, adjusting the size of said surface segments 10—and thus the spacing of said longitudinal lines 11 and of said circumferences 12 perpendicular to the symmetry axis of the reflector and parallel to each other—and the size and number of said reliefs 13, it is possible to affect the uniformity and the mixing degree of the resulting light emission.

A further parameter which may be adjusted to change the mixing degree is the height of said reliefs 13, i.e. the extent of projection of said reliefs 13 from the surface of said surface segments 10.

In further preferred embodiments of the reflector according to the present invention, in order to obtain different mixing degrees of the overall light emitted by the lighting apparatus using it, the internal surface of said reflector is only partially covered by said plurality of surface segments 10 in turn comprising said plurality of reliefs 13.

Advantageously, moreover, the reflector according to the present invention comprises an edge 14 to ease the assembly thereof within the respective lighting apparatus.

The apparatus of the present invention has been described above and in the attached drawings; however, modifications will be apparent to those of ordinary skill in the art and the scope of protection for the invention is to be defined by the claims that follow.

The invention claimed is:

1. A reflector for lighting apparatuses of the roto-symmetric type comprising an apex, comprising a first opening of size such to accommodate a light source and a second opening, larger in size than the first opening, adapted to let out the direct light emitted by said light source and the light reflected by the internal surface of the reflector, said first and second openings having the centre on the axis of rotational symmetry of said reflector and said internal surface comprising a plurality of surface segments delimited by line segments resulting from the intersection of a plurality of longitudinal, substantially curved lines, lying on said internal surface and originating from the geometric apex of said reflector, with a plurality of circumferences lying on said internal surface as well and having the centre on said axis of rotational symmetry, characterized in that each and every one of said surface segments comprise a plurality of superimposed curved reliefs having a convexity facing towards the inside of the reflector.

2. The reflector according to claim 1, wherein said reliefs have the shape of spherical surface portions having convexity facing the inside of the reflector.

3. The reflector according to claim 2, wherein said spherical surface portions all have the same curvature radius.

4. The reflector according to claim 1, wherein said reliefs completely cover the surfaces of said surface segments.

5. The reflector according to claim 1, wherein the perimeters of said reliefs are oriented so that the diagonal has an inclination with respect to said circumferences within an angle comprised between +30° and −30°.

6. The reflector according to claim 1, wherein the perimeters of said reliefs are oriented so that a diagonal is parallel to said circumferences.

7. The reflector according to claim 1, wherein the internal surface of said reflector is entirely covered by said plurality of surface segments.

8. The reflector according to claim 1, wherein the profile of said surface segments underneath said curved reliefs is flat.

9. The reflector according to claim 1, comprising an edge adapted to ease the assembly thereof within the respective lighting apparatus.

10. A lighting apparatus comprising a reflector according to claim 1.

11. A reflector according to claims 1, wherein the profile of said surface segments underneath said curved reliefs is curved.

* * * * *